US012179089B2

(12) United States Patent
Finlayson et al.

(10) Patent No.: US 12,179,089 B2
(45) Date of Patent: Dec. 31, 2024

(54) TEMPORARY COURT MARKING SYSTEM FOR HARD SURFACE COURTS

(71) Applicant: Cortable LLC, Sacramento, CA (US)

(72) Inventors: James Brian Finlayson, Temecula, CA (US); Rebecca Ann Finlayson, Temecula, CA (US)

(73) Assignee: Cortable LLC, Sacramento, CA (US)

( * ) Notice: Subject to any disclaimer, the term of this patent is extended or adjusted under 35 U.S.C. 154(b) by 137 days.

(21) Appl. No.: 18/097,151

(22) Filed: Jan. 13, 2023

(65) Prior Publication Data

US 2023/0285839 A1 Sep. 14, 2023

Related U.S. Application Data

(63) Continuation of application No. 18/095,505, filed on Jan. 10, 2023, now abandoned.

(60) Provisional application No. 63/319,091, filed on Mar. 11, 2022.

(51) Int. Cl.
*A63C 19/06* (2006.01)

(52) U.S. Cl.
CPC ..... *A63C 19/065* (2013.01)

(58) Field of Classification Search
CPC ..... A63C 19/06; A63C 19/08; A63C 19/065; A63C 19/00; A63C 2019/085
USPC ..... 473/490
See application file for complete search history.

(56) References Cited

U.S. PATENT DOCUMENTS 4,880,243 A * 11/1989 Raub ..... A63C 19/065 473/490
2009/0020954 A1* 1/2009 Contreras ..... A63B 67/06 273/338
2015/0148154 A1* 5/2015 McRoskey ..... A63C 19/065 473/490

OTHER PUBLICATIONS

Deluxe Pickleball Court Lines—Pickleball Court Tape | OnCourt OffCourt, 4 pages, retrieved on Jan. 3, 2023, available at http://oncourtoffcourt.com/deluxe-pickleball-line-set/.
"Portable PickPlay," The innovative portable court, 6 pages, retrieved on Jan. 3, 2023, available at https://pickplay.fr and youtube at https://youtu.be/D9UdGFUIZPQ.

* cited by examiner

*Primary Examiner* — Jeffrey S Vanderveen
(74) *Attorney, Agent, or Firm* — Foley & Lardner LLP

(57) ABSTRACT

A play surface marking system may include a first fabric strip configured to be attached to a play surface using a first adhesive strip and a second adhesive strip, wherein the first fabric strip defines a first boundary on the play surface and a second fabric strip configured to be attached to the play surface using a third adhesive strip and a fourth adhesive strip, wherein the second fabric strip defines a second boundary on the play surface.

19 Claims, 4 Drawing Sheets

TEMPORARY COURT MARKING SYSTEM FOR HARD SURFACE COURTS

CROSS-REFERENCE TO RELATED APPLICATIONS

This application is a continuation of U.S. patent application Ser. No. 18/095,505, filed Jan. 10, 2023, which claims priority to U.S. Provisional Application No. 63/319,091, filed Mar. 11, 2022, which application is herein incorporated by reference for all it discloses.

BACKGROUND

The present disclosure relates generally to marking systems for sports and play area courts.

Traditional sports such as pickleball, tennis, volleyball, basketball, badminton, etc. may be played on hard surface courts. However, suitable areas for practice and competition among amateur athletes may not be readily available. In some cases, players, coaches, and/or organizers for participants may locate available areas of cement or asphalt in parks, school yards, gymnasiums, parking lots, and the like, then proceed to define the playing field with makeshift objects such as clothing, gym bags or cones. Such systems may create a trip hazard and are typically insufficient in maintaining court markers in a fixed position.

The present disclosure offers safety improvements and other advantages over these systems, as discussed herein.

SUMMARY

According to various arrangements, disclosed is a court marking system which may include durable fabric strips, along with adhesive tape for forming premeasured court boundaries to nearly any hard surface. The court boundary markers are temporary, reusable, and can be set up, taken down, and stored easily. The disclosed system may be used for sports such as pickleball, tennis, volleyball, basketball, badminton, and other sports that can be played on a surface.

The present disclosure provides systems that improve safety over conventional systems. The court marking system discussed herein allows for a play area to be temporarily defined such that the markings do not interfere with play and such that the markings are easily removable and/or transferable to a new surface.

Some arrangements of the present disclosure are directed to a fabric strip configured to define a line on a surface, the fabric strip including a first loop attached to a first end of the fabric strip, wherein the first loop is configured to receive a first adhesive strip such that the first adhesive strip attaches the first loop to the surface, a second loop attached to a second end of the fabric strip, wherein the second loop is configured to receive a second adhesive strip such that the second adhesive strip attaches the second loop to the surface, and a middle portion disposed between the first loop and the second loop.

In some arrangements, the first and second loops are attached to the surface such that the middle portion is under tension. In some arrangements, the middle portion is configured to receive one or more additional adhesive strips. In some arrangements, the first loop and the second loop include a same material as the middle portion. In some arrangements, the first loop is formed by attaching the first end of the fabric strip to the fabric strip, and wherein the second loop is formed by attaching the second end of the fabric strip to the fabric strip. In some arrangements, the first and second loops are configured to be substantially flat on the surface. In some arrangements, a thickness of the first and second loops is no thicker than 2 times a thickness of the fabric strip. In some arrangements, the first loop is configured to attach to a first loop of a second fabric strip. In some arrangements, the middle portion includes an elastic material. In some arrangements, a thickness of the middle portion is less than 2 millimeters.

Some arrangements of the present disclosure are directed to play surface marking system including a first fabric strip configured to be attached to a play surface using a first adhesive strip and a second adhesive strip, wherein the first fabric strip defines a first boundary on the play surface, and a second fabric strip configured to be attached to the play surface using a third adhesive strip and a fourth adhesive strip, wherein the second fabric strip defines a second boundary on the play surface.

In some arrangements, the first fabric strip includes a first loop attached to a first end of the first fabric strip, wherein the first loop is configured to receive the first adhesive strip such that the first adhesive strip attaches the first loop to the surface, a second loop attached to a second end of the first fabric strip, wherein the second loop is configured to receive the second adhesive strip such that the second adhesive strip attaches the second loop to the surface, a first middle portion disposed between the first loop and the second loop, and the second fabric strip includes a third loop attached to a third end of the second fabric strip, wherein the third loop is configured to receive the third adhesive strip such that the third adhesive strip attaches the third loop to the surface, a fourth loop attached to a fourth end of the second fabric strip, wherein the fourth loop is configured to receive the fourth adhesive strip such that the fourth adhesive strip attaches the fourth loop to the surface, and a second middle portion disposed between the third loop and the fourth loop. In some arrangements, the first and second loops are attached to the surface such that the first middle portion is under tension, and wherein the third and fourth loops are attached to the surface such that the second middle portion is under tension. In some arrangements, the first fabric strip is perpendicular to the second fabric strip. In some arrangements, the first loop and the third loop include a combined loop configured to be attached to the play surface using the first adhesive strip. In some arrangements, the first boundary line and the second boundary line are boundary lines of a pickleball court. In some arrangements, the first fabric strip is attached to the second fabric strip. In some arrangements, the first fabric strip is sewn to the second fabric strip. In some arrangements, the first fabric strip is removably attached to the second fabric strip. In some arrangements, the first fabric strip and the second fabric strip are formed from a single fabric material, such that the play surface marking system is monolithic.

BRIEF DESCRIPTION OF THE DRAWINGS

The detailed description of some embodiments of the present disclosure will be made below with reference to the accompanying figures, wherein the figures disclose one or more embodiments of the present disclosure.

DETAILED DESCRIPTION

Figure 1:
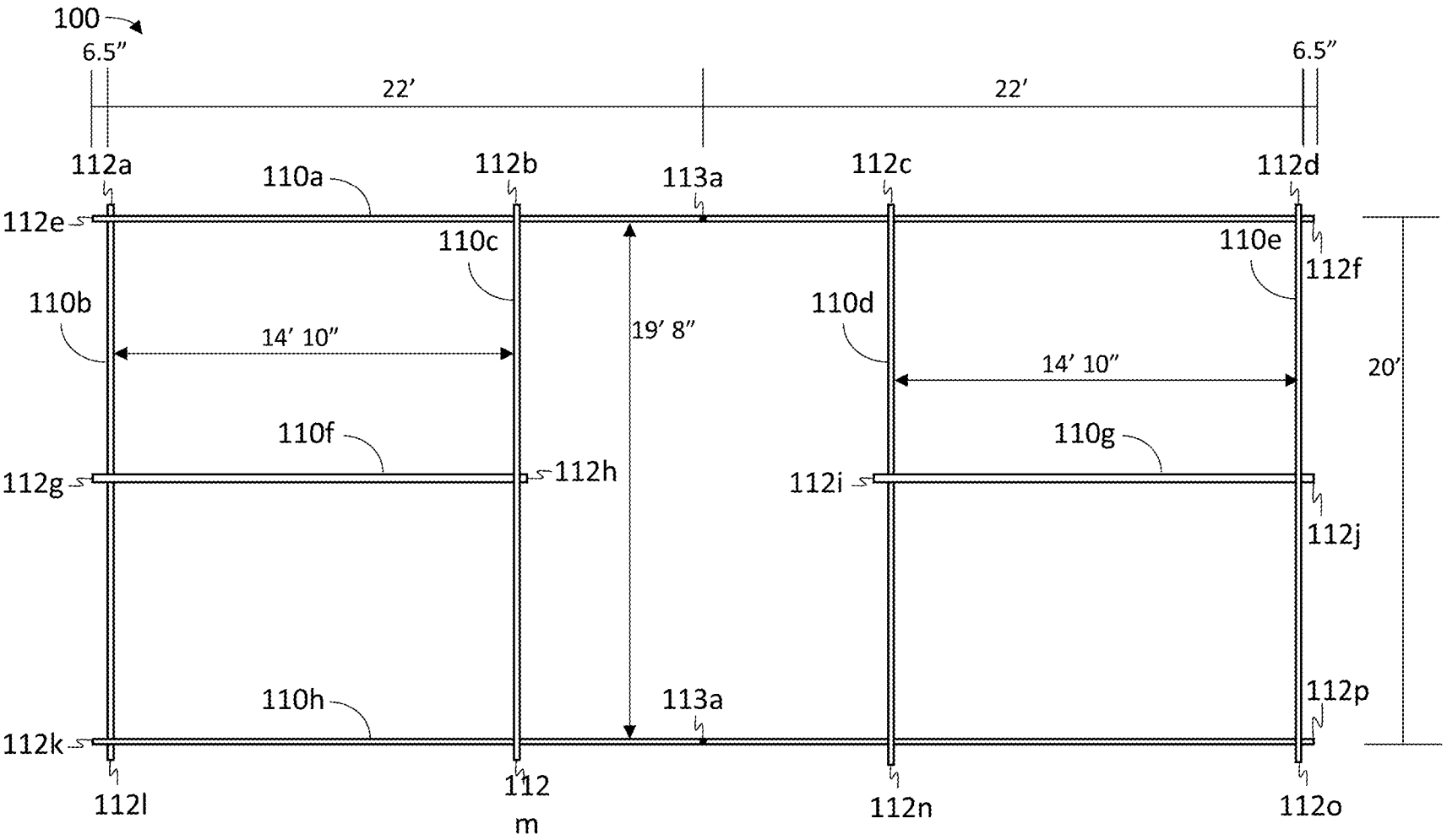
FIG. 1 illustrates a court design using a court marking system, in accordance with one or more embodiments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

According to various embodiments as depicted in FIGS. 1-4, disclosed is a court marking system which may be used for marking boundaries and other designations for sports/play courts on hard surface areas.

FIG. 1 illustrates a court design using a court marking system 100, in accordance with one or more embodiments. The court marking system 100 may include fabric strips 110*a*-110*h*, fabric strip ends 112*a*-112*p*, and center lines 113*a* and 113*b*. The fabric strips 110*a*-110*h* may be thin, flat fabric strips configured to create court boundary markers. The fabric strips 110*a*-110*h* may be laid out on a play surface to define boundaries of a court when the court marking system 100 is deployed to mark boundaries of the court. The play surface may be, for example, concrete, asphalt, wood, etc. and may be either indoors or outdoors. The court marking system 100 may include center lines 113*a* and 113*b*, also known as center marks. The center lines 113*a* and 113 *b* may be lines or markings on one or more of the fabric strips 110*a*-110*h*. For example, the center line 113*a* may mark a center of the fabric strip 110*a* and the center line 113*b* may mark a center of the fabric strip 110*h*. The center lines 113*a* and 113*b* may be dye, color, texture, or fabric different from a remainder of the fabric strips 110*a*-110*h*. For example, the center lines 113*a* and 113*b* may be thread sewn into the fabric strips 110*a* and 110*h*, respectively, to mark the centers of the fabric strips 110*a* and 110*h*, respectively. In some embodiments, the center lines 113*a* and 113*b* include one or more tabs or loops (not shown). In some embodiments, the center lines 113*a* and 113*b* may mark points on one or more of the fabric strips 110*a*-110*h* other than a center. In some embodiments, the center lines 113*a* and 113*b* may mark points of intersection of the fabric strips 110*a*-110*h*. In some embodiments, different center lines may mark different points of intersection of the fabric strips 110*a*-110*h* for different arrangements of the court marking system. For example, a first set of center lines of a first color may mark points of intersection of the fabric strips 110*a*-110*h* for a pickleball court and a second set of center lines of a second color may mark points of intersection of the fabric strips 110*a*-110*h* for a volleyball court. In some embodiments, the center lines 113*a* and 113 *b* may mark a location for a net. For example, the center lines 113*a* and 113*b* may mark a location for a pickleball net. The fabric strips 110*a*-110*h* may be a bright and/or contrasting color such that they are visible against the play surface. In some embodiments, the fabric strips 110*a*-110*h* may all be of one color. In other embodiments, the fabric strips 110*a*-110*h* may be of different or various colors. In some embodiments, the fabric strips 110*a*-110*h* may each include one or more colors. For example, the fabric strips 110*a*-110*h* may have colors to denote specific areas of the play surface or colors to denote sides of the play surface. In an example, the fabric strips 110*a*-110*h* may have colors such that a first side of a court is a first color and a second side of a court is a second color. The fabric strips 110*a*-110*h* may be thin and flat so as to not interfere with play. In some embodiments, the fabric strips 110*a*-110*h* may have a thickness less than or equal to 1 mm. In other embodiments, the fabric strips 110*a*-110*h* may have a thickness less than or equal to 2 mm. In yet other embodiments, the fabric strips 110*a*-110*h* may have a thickness less than or equal to 6 mm. A thickness over 6 mm may be a trip hazard. In some embodiments, the fabric strips 110*a*-110*h* may have a thickness less than or equal to 12 mm. A middle portion of each of the fabric strips 110*a*-110*h* may have a first thickness, and an attachment portion, or attachment site of the fabric strips 110*a*-110*h* may have a second, greater thickness. For example, the loop portion of the fabric strips 110*a*-110*h* may have a thickness less than or equal to 6 mm and the attachment portion, or attachment site of the fabric strips 110*a*-110*h* may have a thickness less than or equal to 12 mm. The fabric strips 110*a*-110*h* may be in a range between 2 mm and 6 mm.

The fabric strip ends 112*a*-112*p* may be configured to be attached to the play surface. In some embodiments, the fabric strip ends 112*a*-112*p* may be attached to the play surface using adhesive strips. For example, the fabric strip ends 112*a*-112*p* may each be attached to the play surface using one or more strips of tape. In some embodiments, the fabric strip ends 112*a*-112*p* may include loops configured to receive adhesive strips. The fabric strip ends 112*a*-112*p* may hold the fabric strips 110*a*-110*h* tight against the play surface. The fabric strips 110*a*-110*h* may be under tension. Each of the fabric strips 110*a*-110*h* may include a middle portion which may be under tension.

The fabric strips 110*a*-110*h* may cross one another to define the boundaries. In an example, the fabric strip 110*a* may be perpendicular to the fabric strip 110*b*. In another example, the fabric strip 110*a* may cross the fabric strip 110*b* at a non-right angle. In some embodiments, a first fabric strip of the fabric strips 110*a*-110*h* may include one or more interior loops through which other fabric strips of the fabric strips 110*a*-110*h* may pass. For example, the fabric strip 110*c* may include a first interior loop through which the fabric strip 110*a* passes, a second interior loop through which the fabric strip 110*f* passes, and a third interior loop through which the fabric strip 110*h* passes. In some embodiments, a first fabric strip of the fabric strips 110*a*-110*h* may include one or more attachment sites for attachment to other fabric strips of the fabric strips 110*a*-110*h*. For example, the fabric strip 110*c* may include a first attachment site where the fabric strip 110*c* is attached to the fabric strip 110*a*, a second attachment site where the fabric strip 110*c* is attached to the fabric strip 110*f*, and a third attachment site where the fabric strip 110*c* is attached to the fabric strip 110*h*. In some embodiments, the fabric strips 110*a*-110*h* may be permanently attached at the attachment sites. For example, the fabric strips 110*a*-110*h* may be sewn together at the attachment sites. In some embodiments, the fabric strips 110*a*-110*h* may be removably attached at the attachment sites. For example, the fabric strips 110*a*-110*h* may be removably attached using hook and loop at the attachment sites. In some embodiments, the fabric strips 110*a*-110*h* may be permanently attached at first attachment sites and removably attached at second attachment sites. In some embodiments, the permanent attachment sites and the removable attachment sites may depend upon the court design. In some embodiments, the fabric strips 110*a*-110*h* may be formed from a single fabric material, such that the court marking system 100 is monolithic.

In some embodiments, the fabric strip 110*a* is parallel to the fabric strips 110*f*, 110*g*, and 110*h* and perpendicular to the fabric strips 110*b*, 110*c*, 110*d*, and 110*e*. In some embodiments, a length of the fabric strip 110*a* may be 45' 1". The fabric strip 110*a* may be 22' from a point of intersection with the fabric strip 110*b* to the center line 113*a*. The fabric strip 110*a* may be 22' from the center line 113*a* to a point of intersection with the fabric strip 110*e*. In other embodiments, the length of the fabric strip 110*a* may be 20-50'. Extension tabs or loops of the fabric strip 110*a* may extend beyond the points of intersection 6.5" in either direction. In some embodiments, each fabric strip of the fabric strips 110*a*-110*h* includes extension tabs or loops which extend beyond the points of intersection 6.5". This length of extension of 6.5" may provide sufficient length for attaching the extension tabs or loops to the play surface using adhesive elements while being short enough to prevent the extension tabs or loops from folding back on themselves and presenting a trip hazard. In some embodiments, the extension tabs or loops may extend 3-8". In some embodiments, a distance between the fabric strip 110*b* and the fabric strip 110*c* is 14' 10". In other embodiments, the distance between the fabric strip 110*b* and the fabric strip 110*c* is 10-20'. In some embodiments, a distance between the fabric strip 110*d* and the fabric strip 110*e* is 14' 10". In other embodiments, the distance between the fabric strip 110*d* and the fabric strip 110*e* is 10-20'. In some embodiments, a distance between the fabric strip 110*a* and the fabric strip 110*h* is 19' 8". In other embodiments, the distance between the fabric strip 110*a* and the fabric strip 110*h* is 10-30'. In some embodiments, a distance between exterior edges of the fabric strip 110*a* and the fabric strip 110*h* is 20'. In other embodiments, the distance between exterior edges of the fabric strip 110*a* and the fabric strip 110*h* is 10-30'. The dimensions discussed herein may be specific to a particular sport or arrangement of the court marking system. The dimensions may be different or altered dependent upon a sport or arrangement of the court marking system.

In some embodiments, the fabric strips 110*a*-110*h* may be attached to one another and measured out according to the form and dimensions of a specific court design, wherein the fabric strips 110*a*-110*h* may mark the inner and outer court boundaries and/or other necessary elements of the court. In some embodiments, the specific court design may be in accordance with official regulations for the particular sport. As such, a kit of multiple pre-attached strips may be pre-designed for a specific court (e.g., pickleball), wherein a user may simply lay out the entire set of pre-attached strips, and attach the fabric strip ends 112*a*-112*p* to the play surface, in order to create the pre-designed court. In other embodiments, a kit of unattached strips may be provided, such that the user may lay out the fabric strips 110*a*-110*h* in any configuration to create the desired court markings. In some embodiments, the kit of unattached fabric strips 110*a*-110*h* may be used to create different types of courts (i.e., pickleball, volleyball, etc.). In some embodiments, one or more fabric strip ends of the fabric strip ends 112*a*-112*p* may be configured to be attached to one another to extend a length of corresponding fabric strips. Extending the length of one or more fabric strips may expand a number of possible configurations of the fabric strips for various types of courts and boundaries. The fabric strip ends 112*a*-112*p* may be strategically placed so as to allow the fabric strips to be pulled tight against the play surface.

In some embodiments, the fabric strips used to create the court design are generally linear. It shall be appreciated however, that the strips are not limited to a linear configuration and may include various curvatures and other geometric profiles in different embodiments, depending on the desired court design. In some embodiments, the fabric strip(s) may be made of a polypropylene webbing but are not limited to this option. In some embodiments, the fabric strip(s) may be very thin, i.e., less than about 2 millimeters, so as to not interfere with play. Additionally, the use of adhesive tape allows the fabric strips to be pulled tightly enough to eliminate wrinkles and folds, such that the fabric strips may remain in close contact with the play area surface, to create a substantially flat playing surface.

Figure 2B:
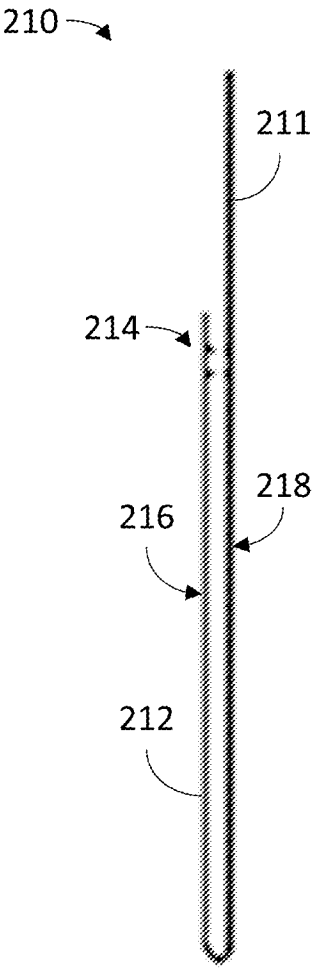
FIGS. 2A and 2B illustrate a loop of a fabric strip, in accordance with one or more embodiments.
Figure 2A:
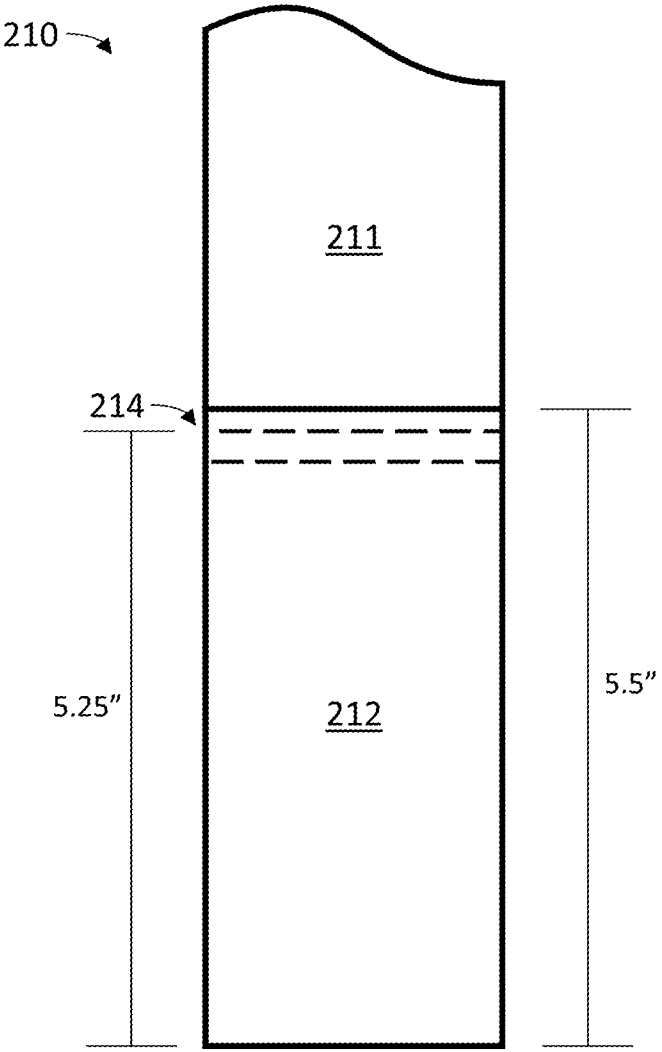

FIGS. 2A and 2B illustrate a loop 212 of a fabric strip 210, in accordance with one or more embodiments. The loop 212 can also be referred to as an extension tab. The fabric strip 210 may be one of the fabric strips 110*a*-110*h* of FIG. 1. The fabric strip 210 may include a middle portion 211, the loop 212, and stitching 214. The loop 212 may be a fabric strip end of the fabric strip ends 112*a*-112*p* of FIG. 1. The fabric strip 210 may include the loop 212 on a first end of the fabric strip 210 and a second loop on a second end of the fabric strip 210. The second loop may be identical or a mirror image of the loop 212. The middle portion 211 may be disposed between the loop 212 and the second loop. In some embodiments, the loop 212 may be formed of a same material as the middle portion 211. In some embodiments, the loop 212 may be formed by folding the end of the fabric strip 210 over itself and sewing the end of the fabric strip 210 to itself using the stitching 214. In other embodiments, the loop 212 may be a different material than the middle portion 211 and the loop 212 may be attached to the middle portion 211 using the stitching 214. In some embodiments, durable thread, which is suitable for outdoor use, may be used for sewing together the fabric strips and/or looped ends as the stitching 214. It shall be appreciated, however, that attachment of the fabric strips and looped ends is not limited to sewing, and that other bonding methods may be used in alternate embodiments. In some embodiments, a thickness of the loop 212 may be less than or equal to two times a thickness of the middle portion.

Figure 3:
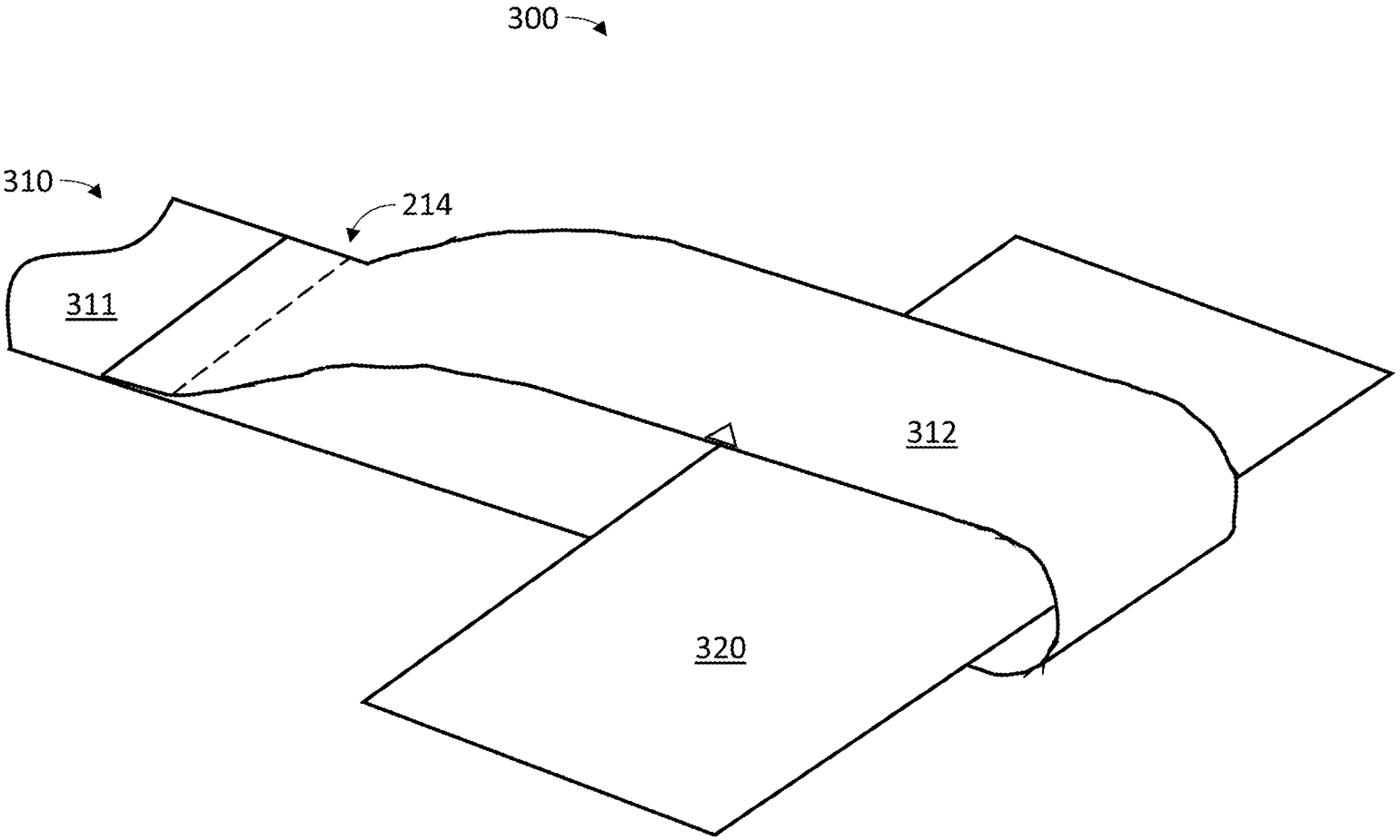
FIG. 3 illustrates the taping down of a looped end of a fabric strip of a court marking system, according to some embodiments.

FIG. 3 illustrates the taping down of a loop 312 of a fabric strip 310 of a court marking system, according to some embodiments. The court marking system may be the court marking system 100 of FIG. 1 and the fabric strip 310 may be the fabric strip 110*a* of FIG. 1 or the fabric strip 210 of FIG. 2. The fabric strip 310 may include the loop 312, a middle portion 311, and a stitching 314. The loop 312 may be configured to receive an adhesive strip 320, otherwise called an adhesive element. The adhesive strip 320 may secure the loop 312 to a play surface, as discussed in FIG. 1, when the court marking system is deployed. In some embodiments, the adhesive strip 320 may be tape. The loop 312 may be attached to the play surface such that the middle portion 311 is under tension and lies flat against the play surface. In some embodiments, the middle portion 311 includes an elastic material, such as elastic tape, to increase a tightness of the middle portion. In some embodiments, the middle portion 311 may be configured to be attached to the play surface using one or more additional adhesive strips.

In some embodiments, the adhesive strip 320 may pass through the loop 312 and then attach the loop 312 to the play surface. This enables a user to secure the fabric strip 310 to the surface by passing the adhesive strip 320 through the loop 312, with an adhesive side of the adhesive strip 320 facing the play surface, and then pressing the adhesive strip 320 against the playing surface. As such, the user may securely affix the boundaries to the play surface. The loop 312 may be configured to be substantially flat on the play surface. The loop 312 may be substantially flat on the play surface when the adhesive strip 320 holds the loop 312 to the play surface. The loop 212 may include a top surface 216 and a bottom surface 218. In some embodiments, the fabric strip 310 includes a first loop and a second loop. In some embodiments, the first loop has a first top surface, a first bottom surface, and a first thickness extending between the first top surface and the first bottom surface. When the first loop is deployed, the first bottom surface faces the surface, the first top surface faces away from the surface, and the first thickness is less than a width of the first top surface or a width of the first bottom surface. In some embodiments, the second loop has a second top surface, a second bottom surface, and a second thickness extending between the second top surface and the second bottom surface. When the second loop is deployed, the second bottom surface faces the surface, the second top surface faces away from the surface, and the second thickness is less than a width of the second top surface or a width of the second bottom surface.

In some embodiments, two fabric strips may cross perpendicular to each other such that their loops are attached to the play surface. In other embodiments, the two perpendicular fabric strips may be attached and a centered loop may attach the two perpendicular fabric strips to the play surface, where the centered loop is centered with respect to the fabric strips such that the centered loop forms an angle of about 135 degrees with respect to the two perpendicular fabric strips. In some embodiments, the two perpendicular fabric strips are removably attached and the loops of the two perpendicular fabric strips are combined, nested within each other, or positioned adjacent one another to form a combined loop configured to be attached to the play surface using a single adhesive strip.

In some embodiments, a length of the loop (when flat) may be 4-6". In some embodiments, a length from an end of the loop (when flat) to the stitching 212 may be 5.25". A length from the end of the loop to an end of the fabric strip 211 may be 5.5". A length between the stitching 214 and the end of the fabric strip 211 may be 0.25". In some embodiments, a length from the end of the loop to the stitching 212 may be 3-7". A length from the end of the loop to an end of the fabric strip 211 may be 3-8". A length between the stitching 214 and the end of the fabric strip 211 may be 0.01-1". The dimensions discussed herein may be specific to a particular application of the loop 211. For example, the dimensions may be specific to a particular adhesive element, a particular surface, or a particular sport. The dimensions may vary based on the adhesive element, the surface, or the sport.

Figure 4:
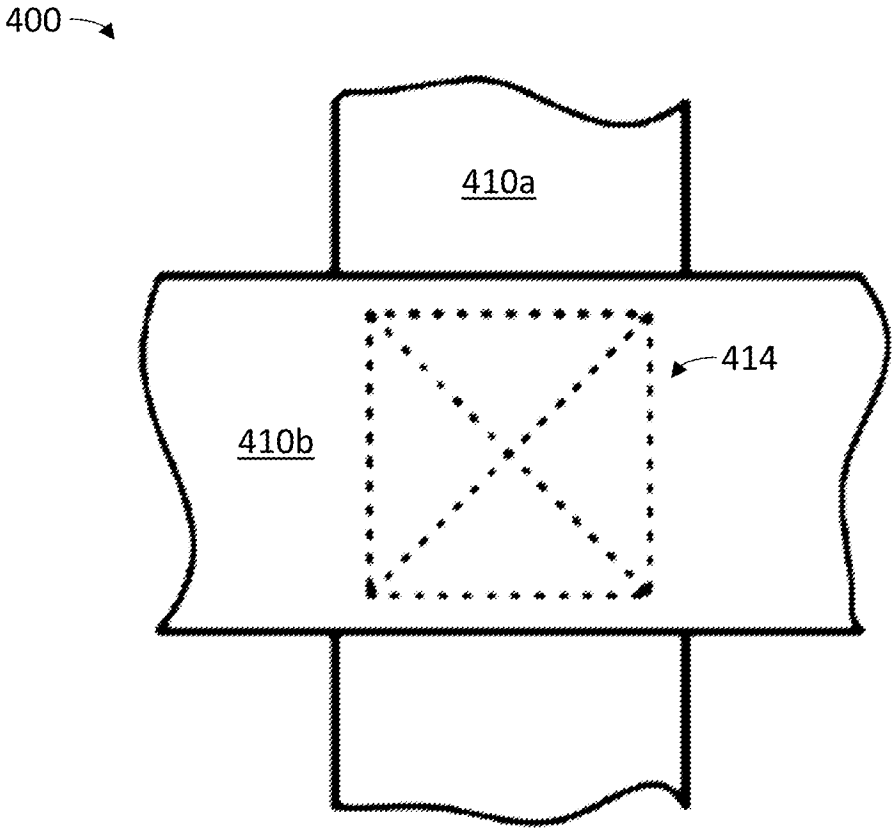
FIG. 4 illustrates an intersection of a first fabric strip and a second fabric strip in a court marking system.

FIG. 4 illustrates an intersection 400 of a first fabric strip 410*a* and a second fabric strip 410*b* in a court marking system. The intersection 400 may be an attachment site of the first fabric strip 410*a* and the second fabric strip 410*b* as discussed herein. The intersection 410 may include a stitching 414 which attaches the first and second fabric strips 410*a*, 410*b* to each other. In some embodiments, the stitching 414 may be a square joint, as shown. As discussed herein, the intersection 400 may include a hook-and-loop fastener (e.g., Velcro), such that the first fabric strip 410*a* and the second fabric strip 410*b* are removably attached to each other. In some embodiments, the intersection 400 may include adhesives, buttons, zippers, toggles, snaps, magnets, pins, buckles, or other attachment mechanisms.

In some embodiments, the first fabric strip 410*a* and the second fabric strip 410*b* may intersect at an attachment site adjacent a first loop of the first fabric strip 410*a* and a second loop of the second fabric strip 410*b*. In some embodiments, the first loop and the second loop extend perpendicular to each other from the attachment site or point of intersection of the first strip and the second strip.

In an example, fabric strips may be laid out flatly on any hard surface to mark desired court boundaries. Strips of adhesive tape may then be inserted through end loops of one of the fabric strips, and the tape may be pressed to the playing surface. This process may then be repeated for the remaining end loops. The user may start with the corner end loops, and pull the fabric strips tightly to ensure that there are no folds or wrinkles, such that the fabric strips are laid flatly against the playing surface. Once the corner end loops have been taped down, the remaining end loops may then be taped. When use of the court is complete, the adhesive tape may be removed, and the fabric strips/court markings stored easily for repeated use.

As such, the disclosed system enables a user to turn any hard surface area into a marked court for various games, sports, and other activities. The court boundary markers are temporary, reusable, and can be set up, taken down and stored easily, eliminating the need for makeshift court markers. By using thin and strong fabric strips and affixing them to the play surface with an adhesive tape, the disclosed court marking system or play surface marking system can be sufficiently durable to stand up to rigorous play and may be held in place without creating an impediment or trip hazard. Additionally, the disclosed system provides a complete premeasured court that is easy to set up, take down, and store.

It shall be appreciated that the disclosed court marking system may be used for a variety of different games, sports, and/or activities, and may be suitable for indoor and/or outdoor use. It shall be appreciated that the disclosed court marking system can have multiple configurations in different embodiments. In some alternate embodiments, hook and loop fasteners, double sided adhesive tape, or other form of adhesive may be used instead of the end loops and tape system. In certain embodiments, warning labels, logos, messages, various decorative elements, etc. may be incorporated onto the fabric strip(s).

It shall be appreciated that the components of the disclosed court marking system may include any alternative known materials in the field and be of any size and/or dimensions. It shall be appreciated that the components of the court marking system described herein may be manufactured and assembled using any known techniques in the field. In one embodiment, the disclosed system may be made by first evaluating the desired court size and shape, then cutting the fabric material into strips, with the length of each strip being equal to the length of each of the lines of the court, plus enough to create a loop on each end of each strip. Multiple fabric strips may then be sewn to one another at intervals that precisely match the dimensions and form of the desired court.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

The invention claimed is:

1. A system, comprising:

a first loop in a first end of a strip, wherein the first loop is configured to receive a first adhesive element transverse to the first loop such that the first adhesive element attaches the first loop to a surface when the system is deployed, wherein the first loop is formed by attaching the first end of the strip to the strip using a first stitching;

a second loop in a second end of the strip, wherein the second loop is configured to receive a second adhesive element transverse to the second loop such that the second adhesive element attaches the second loop to the surface when the system is deployed, wherein the second loop is formed by attaching the second end of the strip to the strip using a second stitching; and a middle portion between the first loop and the second loop, wherein the middle portion is configured to attach to a first middle portion of a second strip perpendicular to the first strip at an attachment site, wherein the first loop extends directly from the attachment site such that a first distance between the first stitching and the attachment site is less than or equal to one inch, and wherein a third loop of the second strip extends directly from the attachment site perpendicular to the first loop such that a second distance between the second stitching and the attachment site is less than or equal to one inch.

2. The system of claim 1, wherein the first and second loops are attached to the surface when the system is deployed, and the middle portion is under tension when the system is deployed.

3. The system of claim 1, wherein the first loop has a first top surface, a first bottom surface, and a first thickness extending between the first top surface and the first bottom surface, wherein when deployed, the first bottom surface faces the surface, the first top surface faces away from the surface, the first thickness is less than a width of the first top surface or a width of the first bottom surface, and wherein the second loop has a second top surface, a second bottom surface, and a second thickness extending between the second top surface and the second bottom surface, wherein when deployed, the second bottom surface faces the surface, the second top surface faces away from the surface, and the second thickness is less than a width of the second top surface or a width of the second bottom surface.

4. The system of claim 3, wherein a thickness of the first loop when deployed is no thicker than 2 times a thickness of the strip, and wherein a thickness of the second loop when deployed is no thicker than 2 times the thickness of the strip.

5. The system of claim 1, wherein the middle portion comprises an elastic material.

6. The system of claim 1, wherein a thickness of the middle portion is less than 6 millimeters.

7. The system of claim 1, wherein the first loop is configured to receive the first adhesive element transverse to the first loop such that the first adhesive element does not extend past the first loop in a direction parallel to the strip away from the attachment site.

8. The system of claim 1, wherein a distal end of the first loop is 3-8 inches from the attachment site.

9. The system of claim 1, wherein the first stitching overlaps with the attachment site.

10. A system comprising:

a first strip configured to be attached to a surface using a first adhesive element and a second adhesive element, wherein the first strip defines a first boundary on the surface, wherein the first strip comprises:

a first loop in a first end of the first strip, wherein the first loop is configured to receive the first adhesive element transverse to the first loop such that the first adhesive element attaches the first loop to the surface when the system is deployed, wherein the first loop is formed by attaching the first end of the first strip to the first strip using a first stitching;

a second loop in a second end of the first strip, wherein the second loop is configured to receive the second adhesive element transverse to the second loop such that the second adhesive element attaches the second loop to the surface, wherein the second loop is formed by attaching the second end of the first strip to the first strip using a second stitching;

a first middle portion between the first loop and the second loop; and a second strip configured to be attached to the play surface using a third adhesive element and a fourth adhesive element, wherein the second strip defines a second boundary on the surface, wherein the second strip comprises:

a third loop in a third end of the second strip, wherein the third loop is configured to receive the third adhesive element perpendicular to the third loop such that the third adhesive element attaches the third loop to the surface, wherein the third loop is formed by attaching the third end of the second strip to the second strip;

a fourth loop attached to a fourth end of the second strip, wherein the fourth loop is configured to receive the fourth adhesive element perpendicular to the fourth loop such that the fourth adhesive element attaches the fourth loop to the surface, wherein the fourth loop is formed by attaching the fourth end of the second strip to the second strip; and a second middle portion between the third loop and the fourth loop, wherein the first middle portion and the second middle portion are attached to each other at an attachment site such that the first middle portion and the second middle portion are perpendicular to each other, and wherein the first loop and the third loop extend directly from the attachment site perpendicular to each other such that a first distance between the first stitching and the attachment site is less than or equal to one inch and a second distance between the third stitching and the attachment site is less than or equal to one inch.

11. The system of claim 10, wherein the first and second loops are attached to the surface such that the first middle portion is under tension, and wherein the third and fourth loops are attached to the surface such that the second middle portion is under tension.

12. The system of claim 10, wherein the first loop and the third loop comprise a combined loop configured to be attached to the play surface using the first adhesive element.

13. The system of claim 10, wherein the first boundary line and the second boundary line are boundary lines of a court.

14. The system of claim 10, wherein the first strip is sewn to the second strip at the attachment site.

15. The system of claim 10, wherein the first strip is removably attached to the second strip.

16. The system of claim 10, wherein the first strip and the second strip are formed from a single fabric material, such that the surface marking system is monolithic.

17. The system of claim 10, wherein the first loop is configured to receive the first adhesive element transverse to the first loop such that the first adhesive element does not extend past the first loop in a direction parallel to the strip away from the attachment site.

18. The system of claim 10, wherein a distal end of the first loop is 3-8 inches from the attachment site.

19. The system of claim 10, wherein the first stitching overlaps with the attachment site.

* * * * *